US008585250B1

(12) United States Patent
Kim et al.

(10) Patent No.: US 8,585,250 B1
(45) Date of Patent: Nov. 19, 2013

(54) OPTICAL SEMICONDUCTOR LIGHTING APPARATUS

(75) Inventors: Dong Soo Kim, Seongnam (KR); Seok Jin Kang, Seongnam (KR); Kyoo Seok Kim, Seongnam (KR); Yoon Gil Jang, Seongnam (KR); Dong Hee Kim, Seongnam (KR); Seong Bok Yoon, Seongnam (KR); Jung Hwa Kim, Seongnam (KR)

(73) Assignee: Posco LED Company, Ltd., Seongnam (KR)

( * ) Notice: Subject to any disclaimer, the term of this patent is extended or adjusted under 35 U.S.C. 154(b) by 0 days.

(21) Appl. No.: 13/596,582

(22) Filed: Aug. 28, 2012

(30) Foreign Application Priority Data

Jul. 10, 2012 (KR) ..... 1 0-201 2-00751 03
Jul. 13, 2012 (KR) ..... 10-2012-0076852

(51) Int. Cl.
*F21V 29/00* (2006.01)

(52) U.S. Cl.
USPC ..... 362/294; 362/249.02; 362/373; 165/80.3

(58) Field of Classification Search
USPC ..... 165/80.3; 362/218, 249.02, 294, 373, 362/547
See application file for complete search history.

(56) References Cited

U.S. PATENT DOCUMENTS

| | | | | |
|---|---|---|---|---|
| 2010/0014289 | A1* | 1/2010 | Thomas et al. | 362/294 |
| 2010/0126697 | A1* | 5/2010 | Huang | 165/80.3 |
| 2012/0182736 | A1* | 7/2012 | Lee et al. | 362/373 |

FOREIGN PATENT DOCUMENTS

| | | |
|---|---|---|
| EP | 2206945 | 7/2010 |
| EP | 2312202 | 4/2011 |
| JP | 2008059965 | 3/2008 |
| JP | 2008103195 | 5/2008 |
| JP | 3155521 | 11/2009 |
| JP | 2009295578 | 12/2009 |
| JP | 2011507152 | 3/2011 |
| KR | 20-1991-0008364 | 5/1991 |
| KR | 10-0927114 | 11/2009 |
| KR | 10-0933990 | 12/2009 |
| KR | 10-1125747 | 3/2012 |
| KR | 20-2012-0001803 | 3/2012 |

OTHER PUBLICATIONS

Japanese Office Action dated Dec. 18, 2012 for JP Application No. 2012-191752.
Japanese Decision to Grant Patent dated May 14, 2013 for JP Application No. 2012-191752.

* cited by examiner

*Primary Examiner* — Stephen F Husar
(74) *Attorney, Agent, or Firm* — H.C. Park & Associates, PLC

(57) ABSTRACT

A first heat sinking path formed in a forming direction of a heat sink unit disposed radially in a housing where a light emitting module is mounted. A second heat sinking path is formed along an edge of the light emitting module. By providing a light engine concept in which a light emitting module, an optical member, and a heat sink unit are included and a bottom surface is gradually widened from one side to the other side, an optical semiconductor lighting apparatus can reduce a total weight of a product, can further improve heat dissipation efficiency by inducing natural convection, is simple in the product assembly and installation, and is easy in maintenance, and can provide products with high reliability by increasing the arrangement efficiency of semiconductor optical devices per unit area.

17 Claims, 19 Drawing Sheets

OPTICAL SEMICONDUCTOR LIGHTING APPARATUS

CROSS-REFERENCE(S) TO RELATED APPLICATION

This application claims priority of Korean Patent Application No. 2012-0075103, filed on Jul. 10, 2012, and Korean Patent Application No. 2012-0076852, filed on Jul. 13, 2012, which are hereby incorporated by reference in their entirety.

BACKGROUND OF THE INVENTION

1. Field of the Invention

The present invention relates to an optical semiconductor lighting apparatus.

2. Description of the Related Art

Compared with incandescent light and fluorescent light, optical semiconductors, such as LEDs or LDs, consume low power, have a long lifespan, and have high durability and high brightness. Due to these advantages, optical semiconductors have recently attracted much attention as one of components for lighting.

Typically, in the lighting apparatuses using such optical semiconductors, heat is inevitably generated from the optical semiconductors. Therefore, it is necessary to install heat sinks at heat generation sites so as to discharge the generated heat to the outside.

As the optical semiconductors have recently become popular and have been mass-produced, unit costs of the optical semiconductors have also been lowered. Therefore, the lighting apparatuses using the optical semiconductors have tended to be used for high power industrial lighting, such as factory lighting, streetlight, or security light.

In the lighting apparatuses using the optical semiconductors, which are used for the high power industrial lighting, generation of heat increases in proportion to the size and power of the lighting apparatuses. As a result, it is necessary to increase the capacity and volume of the heat sink so as to demonstrate excellent heat dissipation performance.

Generally, heat sinks mounted on the lighting apparatuses using the optical semiconductors are manufactured by die casting or the like, such that the heat sinks are integrally or detachably connected to a housing. However, the heat sinks manufactured in such a manner increase the total weight of the product and increase the manufacturing costs and the amount of raw materials used.

In particular, in the case of the conventional heat sinks manufactured by die casting, heat sink fins cannot be formed to have a thickness below a predetermined reference value due to characteristics of the manufacturing method thereof. Hence, a heat dissipation area intended at a limited site is narrow, and the volume and size of the heat sink is increased if a plurality of heat sink fins are formed for securing a sufficient heat dissipation area.

Meanwhile, in this regard, if a heat sink is manufactured in a shape of a heat sink plate by using a sheet (thin plate), a sufficient heat dissipation area may be secured. However, due to the structural limitation that the heat sink should be arranged in a line contact manner, heat generated from optical semiconductors may not be effectively transferred and discharged to the outside.

Furthermore, in the lighting apparatus using the optical semiconductor, a circuit board, on which the optical semiconductors are disposed, is connected to a heat sink, and the circuit board is embedded in a housing. An optical member, such as a lens, which is installed in the housing, allows light from the optical semiconductors to be irradiated more widely or narrowly.

In most cases, the lighting apparatus using the optical semiconductor is disposed on a rectangular or circular circuit board for convenience of manufacturing, and a housing is also rectangular or circular.

However, in view of the number of the lighting apparatuses arranged per unit area in order for high power, if a large number of lighting apparatuses are arranged, the total weight and volume thereof are increased due to the limitation of the structural shape.

SUMMARY OF THE INVENTION

An aspect of the present invention is directed to provide an optical semiconductor lighting apparatus that can reduce a total weight of a product.

Another aspect of the present invention is directed to provide an optical semiconductor lighting apparatus that can further improve the heat dissipation efficiency by inducing natural convection.

Another aspect of the present invention is directed to provide an optical semiconductor lighting apparatus that is simple in the product assembly and installation and is easy in maintenance.

Another aspect of the present invention is directed to provide an optical semiconductor lighting apparatus that can provide products with high reliability by increasing the arrangement efficiency of semiconductor optical devices per unit area.

According to an embodiment of the present invention, an optical semiconductor lighting apparatus includes: a housing; a light emitting module including at least one or more semiconductor optical devices and disposed at an outer side of a bottom surface of the housing; a heat sink unit disposed radially at an inner side of the bottom surface of the housing and forming a communication space at a central portion of the inner side of the bottom surface of the housing; a first heat sinking path formed radially from the central portion of the inner side of the bottom surface of the housing; and a second heat sinking path formed along an edge of the bottom surface of the housing in a vertical direction.

The heat sink unit may include a plurality of heat sink elements each including a pair of heat sink elements that are perpendicular to the bottom surface of the housing and face each other.

The optical semiconductor lighting apparatus may further include a core fixing portion that is disposed at the central portion of the inner side of the bottom surface of the housing and fixes an inner end portion of the heat sink unit.

An outer end portion of the heat sink unit may communicate with the second heat sinking path formed from the outer side of the bottom surface of the housing.

The housing further may include a side wall extending along the edge of the bottom surface of the housing. The heat sink unit may be accommodated inside the side wall. The second heat sinking path may be formed in parallel to the side wall.

The housing may further include a cover that is connected to an upper edge of the side wall and has a communication hole at a central portion thereof.

The housing may further include: a cover mutually communicating with the first and second heat sinking paths and having a communication hole at a central portion thereof; and a plurality of upper vent slot penetrating on circumferences of a plurality of virtual concentric circles formed along a direction in which the cover is formed.

The housing may further include a cover that is disposed at an upper side of the heat sink unit, is connected to the housing, and has a communication hole connected to the communication space.

The cover may further include a plurality of upper vent slots penetrating circumferences of a plurality of virtual concentric circles formed along a direction in which the cover is formed.

The housing may further include a ventilation fan disposed in the communication space.

The housing may further include a plurality of lower vent slots penetrating the bottom surface of the housing along an edge of the light emitting module, and the lower vent slots may mutually communicate with the second heat sinking path.

According to another embodiment of the present invention, an optical semiconductor lighting apparatus includes: a housing in which at least one or more semiconductor optical devices are disposed at an outer side of a bottom surface thereof; a plurality of bottom sheets disposed radially at an inner side of the bottom surface of the housing; and a heat sink sheet extending along both edges of the bottom sheet and facing each other.

The optical semiconductor lighting apparatus may further include: an extension sheet extending from an inner end portion of the bottom sheet toward a central portion of the inner side of the bottom surface of the housing; and a fixing sheet extending along both edges of the extension sheet and facing each other, wherein the fixing sheet is connected to the heat sink sheet.

The optical semiconductor lighting apparatus may further include a core fixing portion that is disposed at the central portion of the inner side of the bottom surface of the housing and fixes an upper edge of the fixing sheet.

The bottom sheet may be formed in a tapered shape, such that the bottom sheet is gradually widened toward the edge of the inner side of the bottom surface of the housing.

The housing may further include a plurality of fixing protrusions that protrude from the inner side of the bottom surface of the housing and are disposed along both edges of the bottom sheet.

The housing may further include a communication space formed between the plurality of bottom sheets and the inner end portion of the heat sink sheet from the central portion of the bottom surface of the housing, and the communication space may communicate with the first heat sinking path.

The housing may further include a ventilation fan disposed in the communication space.

The term "semiconductor optical device" used in claims and the detailed description refers to a light emitting diode (LED) chip or the like that includes or uses an optical semiconductor.

The semiconductor optical devices may include package level devices with various types of optical semiconductors, including the LED chip.

DETAILED DESCRIPTION OF EXEMPLARY EMBODIMENTS

Exemplary embodiments of the present invention will be described below in detail with reference to the accompanying drawings.

Figure 1:
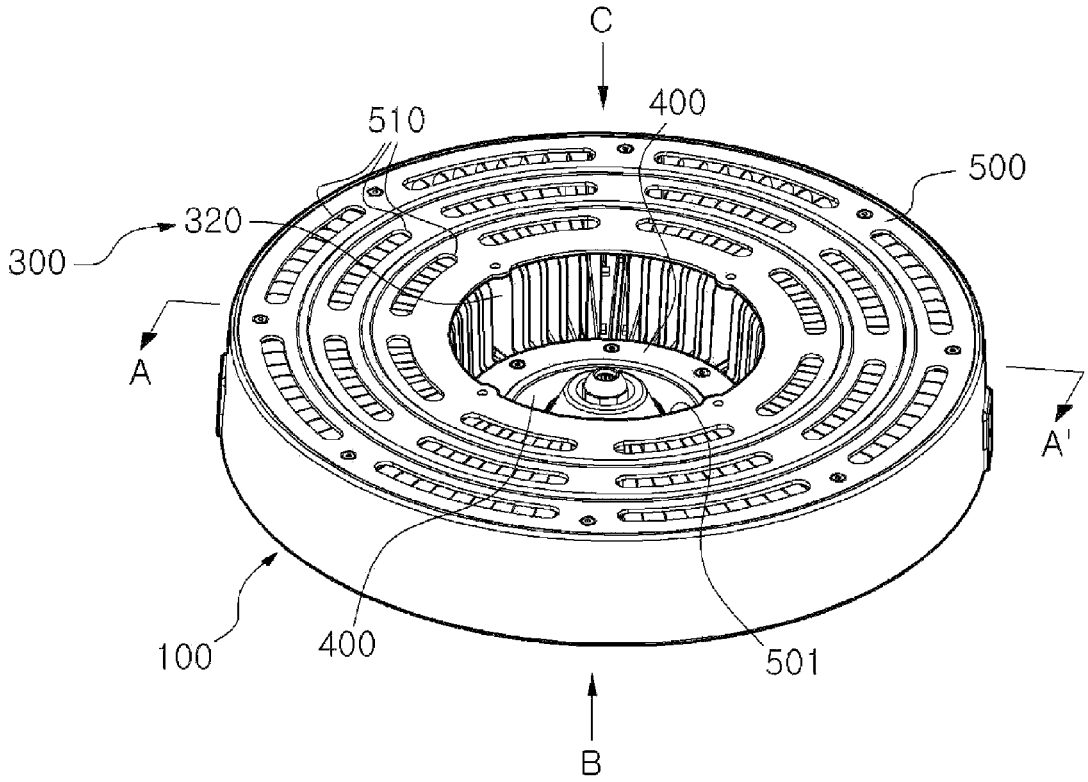
FIG. 1 is a perspective view illustrating an overall configuration of an optical semiconductor lighting apparatus according to an embodiment of the present invention.
Figure 2:
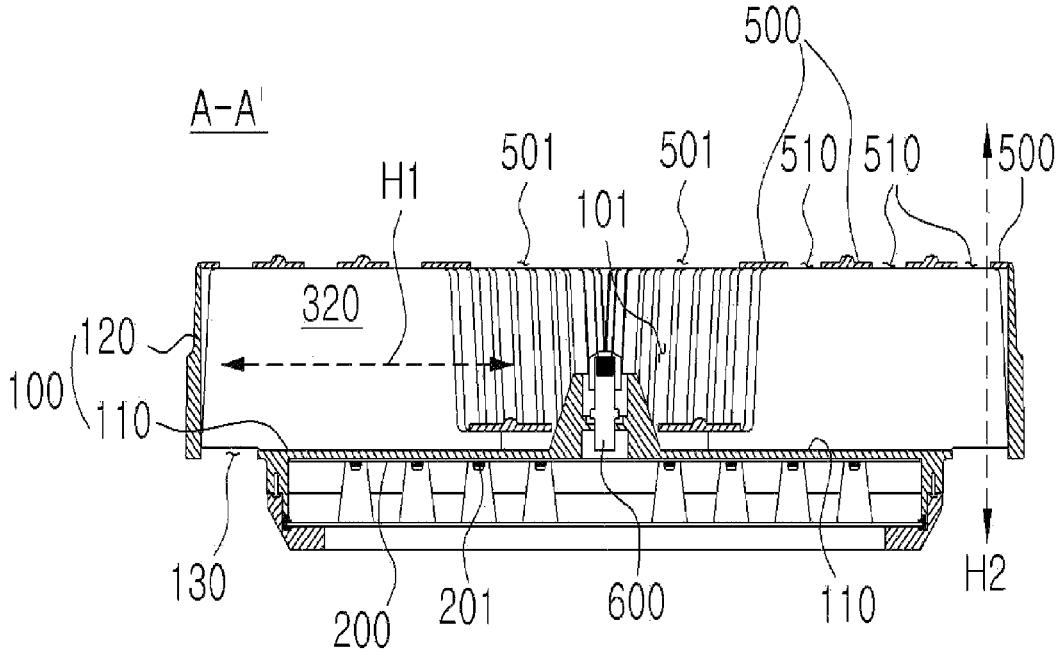
FIG. 2 is a cross-sectional view taken along line A-A' of FIG. 1.
Figure 3:
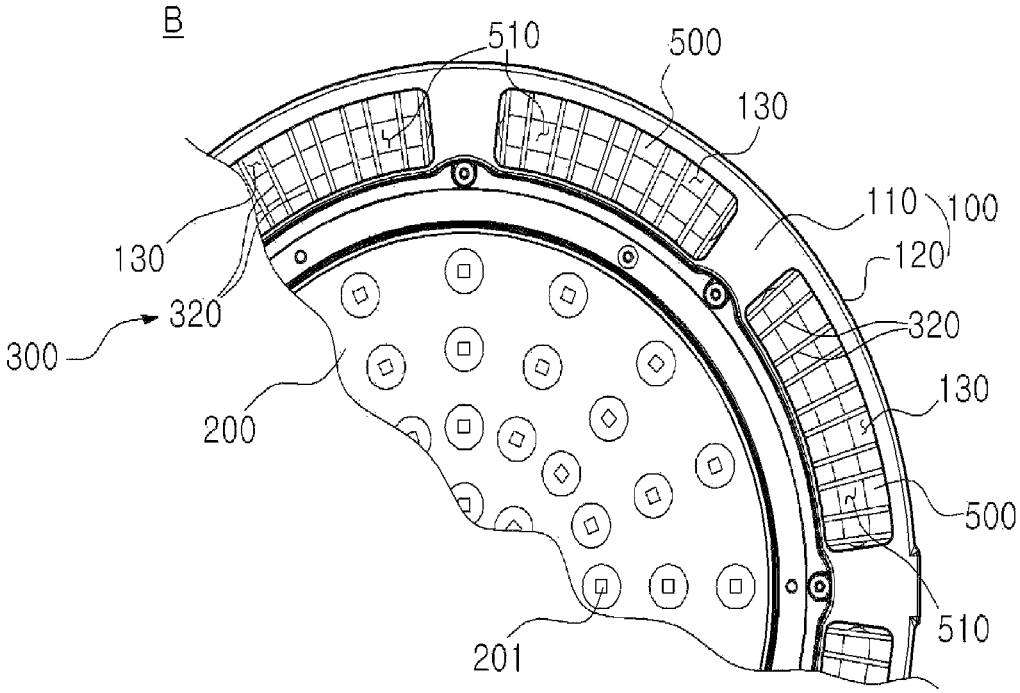
FIG. 3 is a partial conceptual diagram viewed from a viewpoint B of FIG. 1.
Figure 4:
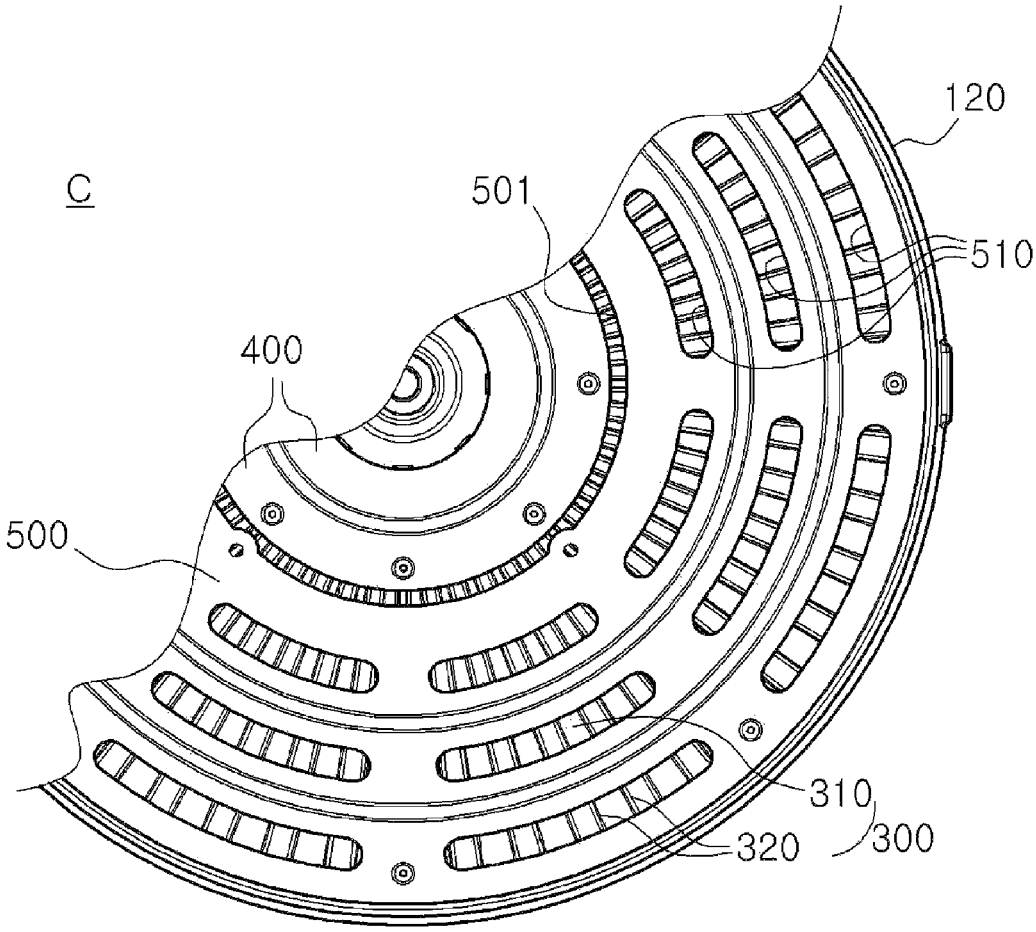
FIG. 4 is a partial conceptual diagram viewed from a viewpoint C of FIG. 1.
Figure 5:
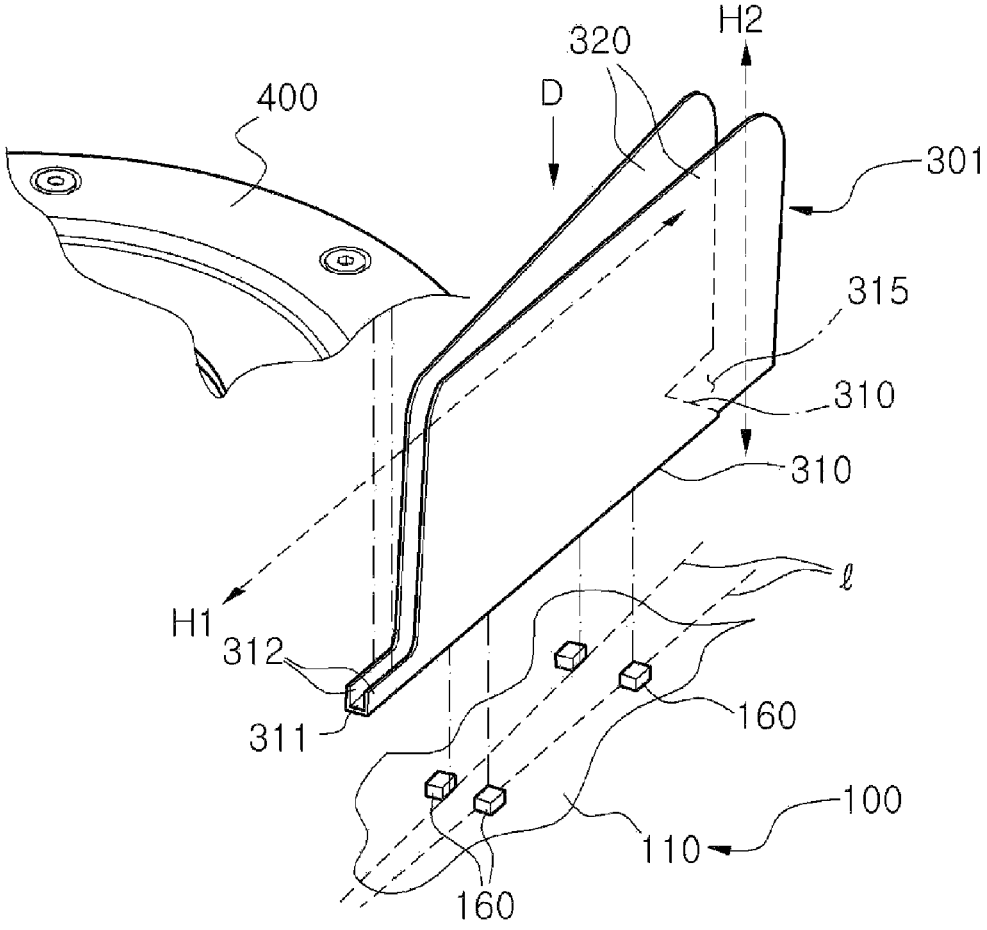
FIGS. 5 to 6 are diagrams illustrating an overall configuration of a unit heat sink element constituting a heat sink unit that is an essential part of the optical semiconductor lighting apparatus according to the embodiment of the present invention.
Figure 6:
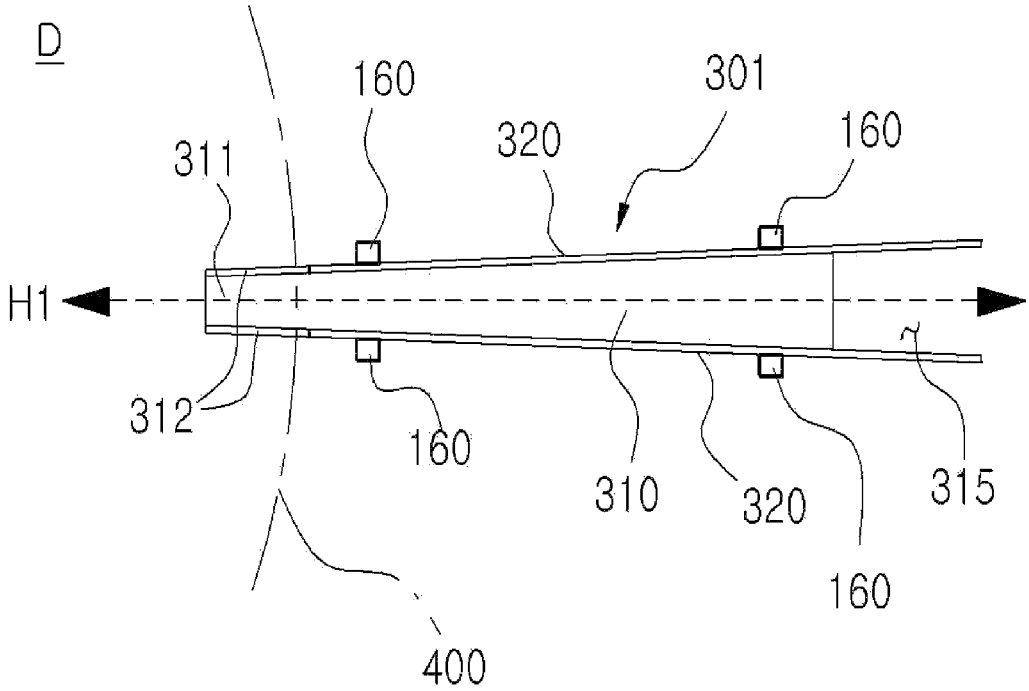

FIG. 1 is a perspective view illustrating an overall configuration of an optical semiconductor lighting apparatus according to an embodiment of the present invention. FIG. 2 is a cross-sectional view taken along line A-A' of FIG. 1. FIG. 3 is a partial conceptual diagram viewed from a viewpoint B of FIG. 1. FIG. 4 is a partial conceptual diagram viewed from a viewpoint C of FIG. 1. FIGS. 5 to 6 are diagrams illustrating an overall configuration of a unit heat sink element constituting a heat sink unit that is an essential part of an optical semiconductor lighting apparatus according to an embodiment of the present invention.

As illustrated, the optical semiconductor lighting apparatus according to the embodiment of the present invention is configured such that a heat sink unit 300 is mounted on a housing 100 where a light emitting module 200 is disposed, and first and second heat sinking paths H1 and H2 are formed inside the housing 100.

For reference, reference numeral 600 in FIG. 2 denotes a waterproof connector. In FIG. 2, an outer side of a bottom surface 110 refers to a side facing a lower side of the drawing from the bottom surface 110, and an inner side of the bottom surface 110 refers to a side facing an upper side of the drawing from the bottom surface 110. The outer side and the inner side of the bottom surface 110 are equally applied throughout the drawings.

The housing 100 provides a space for mounting the light emitting module 200 and the heat sink unit 300, and the light emitting module 200 includes at least one or more semiconductor optical devices 201 and is disposed at the outer side of the bottom surface 110 of the housing 100. The light emitting module 200 serves as a light source.

The heat sink unit 300 is disposed radially at the inner side of the bottom surface 110 of the housing 100, and forms a communication space 101 at an inner central portion of the bottom surface 110 of the housing 100. The heat sink unit 300 discharges heat generated from the light emitting module 200 to the outside of the housing 100.

The first heat sinking path H1 is formed radially from the inner central portion of the bottom surface 110 of the housing 100. To be specific, the first heat sinking path H1 may be formed radially along the direction in which the respective heat sink units 300 are formed.

The second heat sinking path H2 is formed along the edge of the bottom surface 110 of the housing 100 in a vertical direction. To be specific, the second heat sinking path H2 may be formed to communicate in the vertical direction of the housing 100 along the edge of the light emitting module 200.

Therefore, as illustrated, natural convection is actively induced by forming a plurality of paths through which heat generated from the light emitting module 200 is discharged by the first and second heat sinking paths H1 and H2, thereby further increasing the heat dissipation efficiency.

It is apparent that the following various embodiments as well as the above-described embodiment can also be applied to the present invention.

As described above, the housing 100 provides the space for mounting the light emitting module 200 and the heat sink unit 300, and further includes a side wall 120 (see FIG. 2) is extending along the edge of the bottom surface 110 of the housing 100. The side wall 120 surrounds the outside of the heat sink unit 300, and the second heat sinking path H2 is formed in parallel to the side wall 120.

The housing 100 further includes a plurality of lower vent slots 130 penetrating the bottom surface 110 of the housing 100 along the edge of the light emitting module 200, and the lower vent slots 130 mutually communicate with the second heat sinking path H2.

The housing 100 may further include a cover 500 that is connected to an upper edge of the side wall 120 and has communication holes 501 at the central portion thereof.

The cover 500 mutually communicates with the first and second heat sinking paths H1 and H2 and has the communication holes 501 at the central portion thereof. A plurality of upper vent slots 510 penetrating the circumferences of a plurality of concentric circles formed along the direction in which the cover 500 is formed.

To be specific, the communication holes 501 are connected to the communication spaces 101 through the first heat sink path H1, and the second heat sinking path H2 is connected through the outermost upper vent slot 510.

Referring to FIG. 3, the lower vent slots 130 mutually communicate through the upper vent slots 510. This can be understood more clearly with the detailed description of the heat sink unit 300, which will be described later.

As illustrated in FIGS. 1 and 4, the optical semiconductor lighting apparatus according to the embodiment of the present invention may further include a core fixing portion 400 that is disposed at the inner central portion of the bottom surface 110 of the housing 100 to fix an inner end portion of the heat sink unit 300.

In addition, although not specifically illustrated, a ventilation fan may be further mounted in the communication space 101 to forcibly convect heat generated from the light emitting module 200 and discharge the heat to the outside of the housing 100, thereby obtaining a rapid heat dissipation effect.

Meanwhile, as described above, the light emitting module 300 is mounted on the bottom surface 110 of the housing 100 so as to obtain excellent heat dissipation performance. The light emitting module 300 includes a plurality of unit heat sink elements 301 (see FIGS. 5 and 6) each including a pair of heat sink sheets 320 that are perpendicular to the bottom surface 110 of the housing 100 and face each other.

The outer end portion of the heat sink unit 300 communicates with the second heat sinking path H2 formed from the outer side of the bottom surface 110 of the housing 100.

More specifically, the heat sink unit 300 is disposed radially at the inner side of the bottom surface 110 of the housing 100, and includes a plurality of bottom sheets 310 contacting a side opposite to a side where the semiconductor optical device 201 is disposed, that is, the inner side of the bottom surface 110 of the housing 100.

The heat sink unit 300 includes heat sink sheets 320 that extend along both edges of the bottom sheet 310 and face each other.

Therefore, the first heat sinking path H1 is formed radially between the adjacent heat sink sheets 320. The second heat sinking path H2 is formed as follows.

That is, the second heat sinking path H2 is formed perpendicular to the first heat sinking path H1 vertically from the lower vent slots 130 in correspondence to the plurality of lower vent slots 130 penetrating the inner edge of the bottom surface 110 of the housing 100.

The outer end portion of the bottom sheet 310 is cut and removed, and a cut-out portion 315 is formed between the bottom sheet 310 and the heat sink sheet 320. Therefore, the cut-out portion 315 communicates with the lower vent slot 130. The second heat sinking path H2 may be formed through the upper vent slot 510 of the cover 500.

In this case, the heat sink unit 300 may include an extension sheet 311 extending from the inner end portion of the bottom sheet 310 toward the inner central portion of the bottom surface 110 of the housing 100, and a fixing sheet 312 extending along both edges of the extension sheet 311 and facing the extension sheet 311.

The extension sheet 311 provides a space for forming the fixing sheet 312. The fixing sheet 312 serves as a reinforcement structure for distributing and supporting a fixing/supporting force generated by the core fixing portion 400 fixing the upper edge of the fixing sheet 312.

As illustrated and described above, the core fixing portion 400 is disposed at the inner central portion of the bottom surface 110 of the housing 100.

Therefore, the communication space 101 is formed in the upper space of the core fixing portion 400, that is, the space between the plurality of bottom sheets 310 and the inner end portion of the heat sink sheet 320 from the inner central portion of the bottom surface 110 of the housing 100, and the communication space 101 mutually communicates with the first heat sinking path H1.

In addition, as illustrated in FIG. 5, the housing 100 may further include a plurality of fixing protrusions 160 protruding from the inner side of the bottom surface 110 and disposed along both edges of the bottom sheet 310, so as to provide a space for mounting the bottom sheet 310 constituting the unit heat sink element 301 and tightly fix and support the lower side of the heat sink sheet 320.

Furthermore, as illustrated in FIG. 6, the bottom sheet 310 is formed in a tapered shape, such that the bottom sheet 310 is gradually widened toward the inner edge of the bottom surface 110, so as to effectively discharge heat from the central portion of the bottom surface 110 to the outside of the housing 100.

Therefore, in the heat sink unit 300, the bottom sheet 310 and the heat sink sheet 320 constituting the unit heat sink element 301 are formed to have a U-shaped cross-section as a whole, and the bottom sheet 310 is disposed to contact the inner side of the bottom surface 110 of the housing 100. As a result, compared with the conventional heat sink fin structure, the heat transfer area is increased to further improve the heat dissipation effect.

In the conventional lighting apparatus, since the heat sink is manufactured by die casting, the volume and size thereof are increased. However, according to the embodiment of the present invention, the total weight of the product can be reduced by radially arranging the unit heat sink elements 301 including the bottom sheet 310 and the heat sink sheet 320 formed in a thin plate type.

Meanwhile, as illustrated in FIGS. 7 to 19, the structures of a light engine concept can also be applied to the present invention.

In FIGS. 7 to 10, the same reference numerals as used in FIGS. 1 to 6 are assigned to members having the same structures and functions as those of FIGS. 1 to 6.

Figure 7:
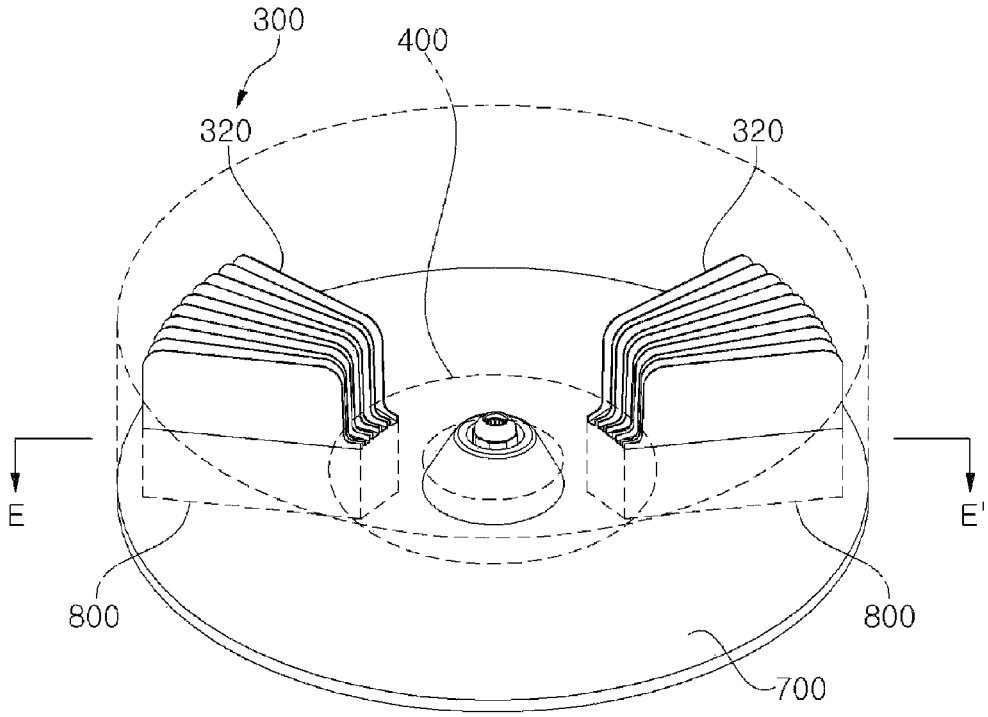
FIG. 7 is a perspective view illustrating an overall configuration of an optical semiconductor lighting apparatus according to an embodiment of the present invention.
Figure 8:
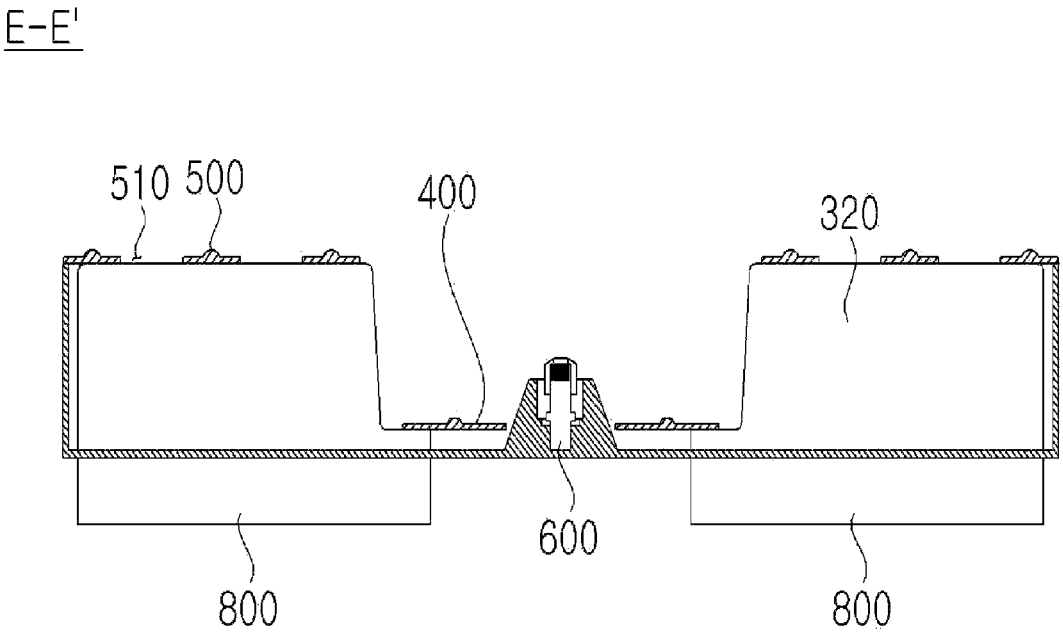
FIG. 8 is a cross-sectional view taken along line E-E' of FIG. 7.

FIG. 7 is a perspective view illustrating an overall configuration of an optical semiconductor lighting apparatus according to an embodiment of the present invention. FIG. 8 is a cross-sectional view taken along line E-E'.

Figure 9:
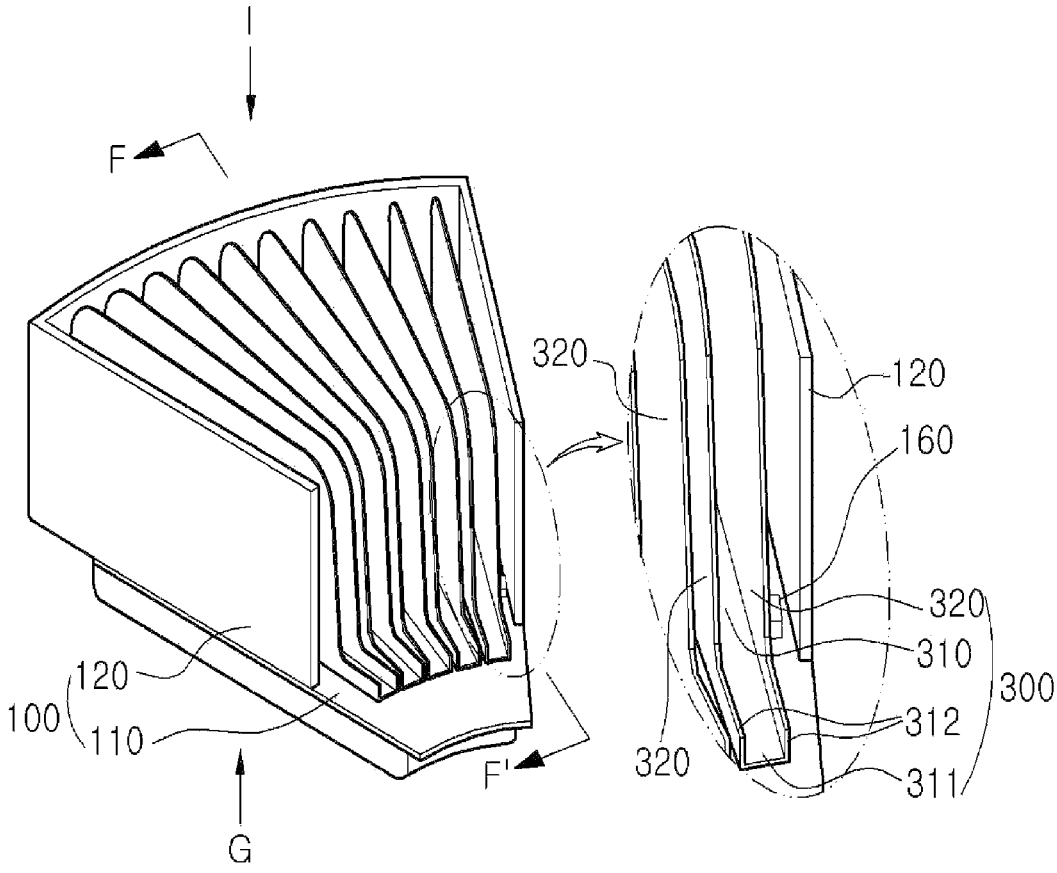
FIG. 9 is a perspective view illustrating an overall configuration of an optical semiconductor lighting apparatus according to another embodiment of the present invention.

FIG. 9 is a perspective view illustrating an overall configuration of an optical semiconductor lighting apparatus according to another embodiment of the present invention.

Figure 10:
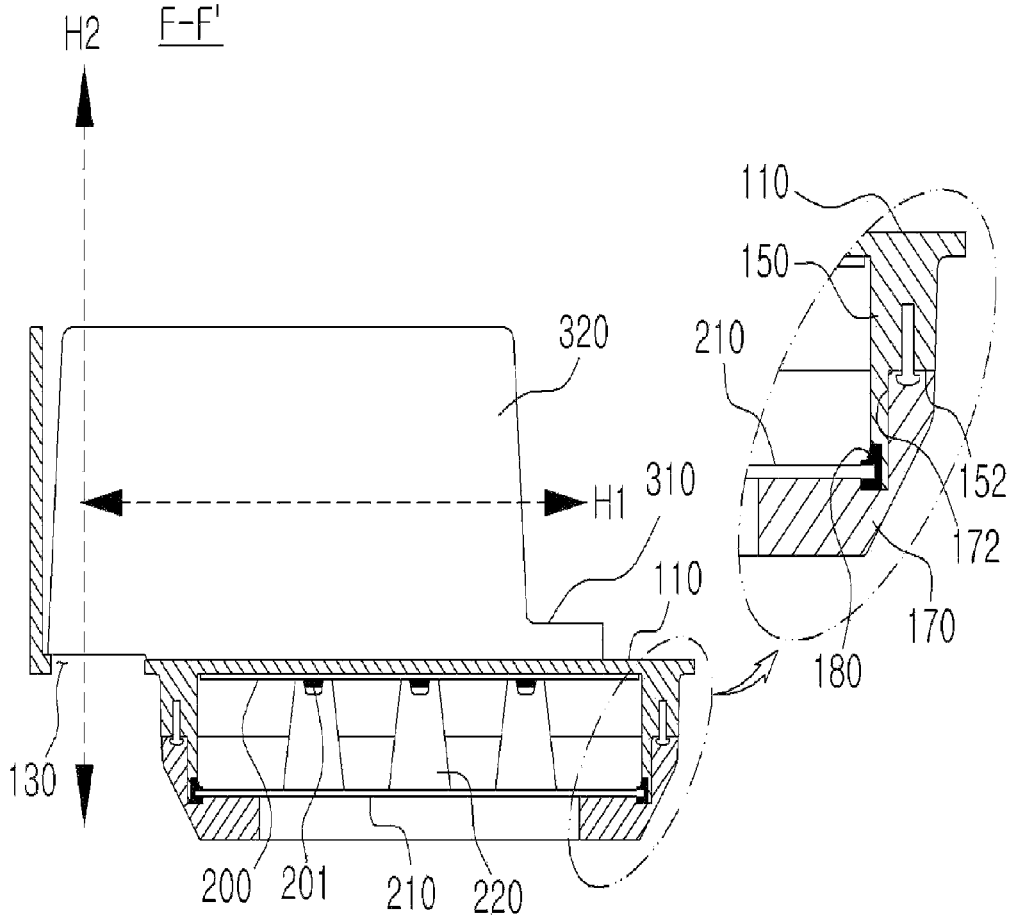
FIG. 10 is a cross-sectional view taken along line F-F' of FIG. 9.
Figure 11:
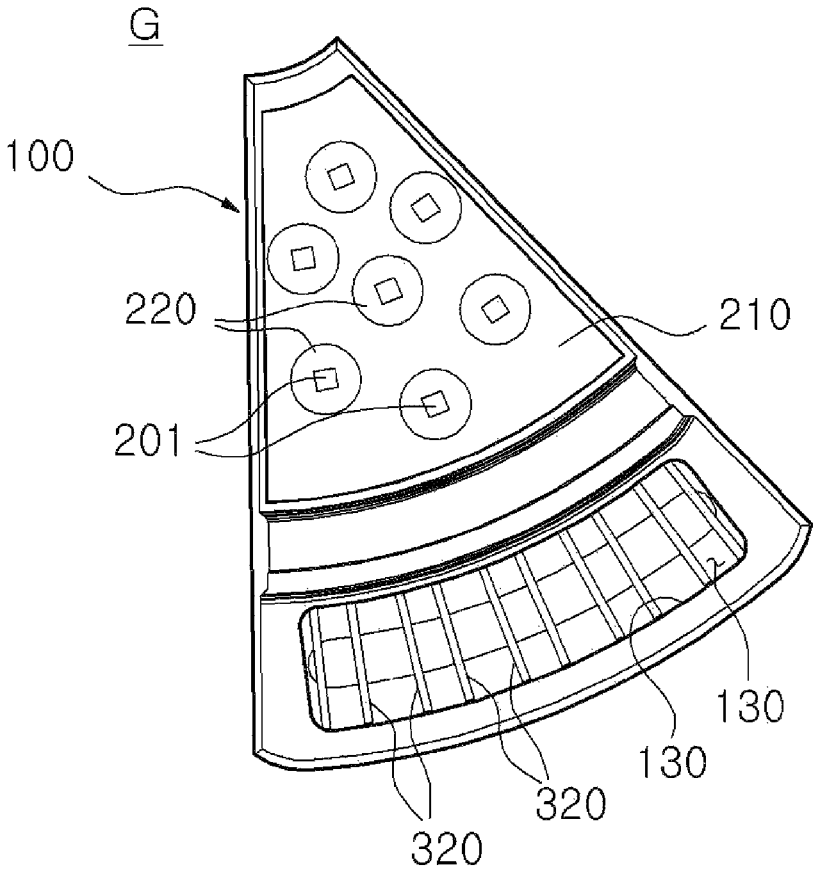
FIG. 11 is a partial conceptual diagram viewed from a viewpoint G of FIG. 9.
Figure 12:
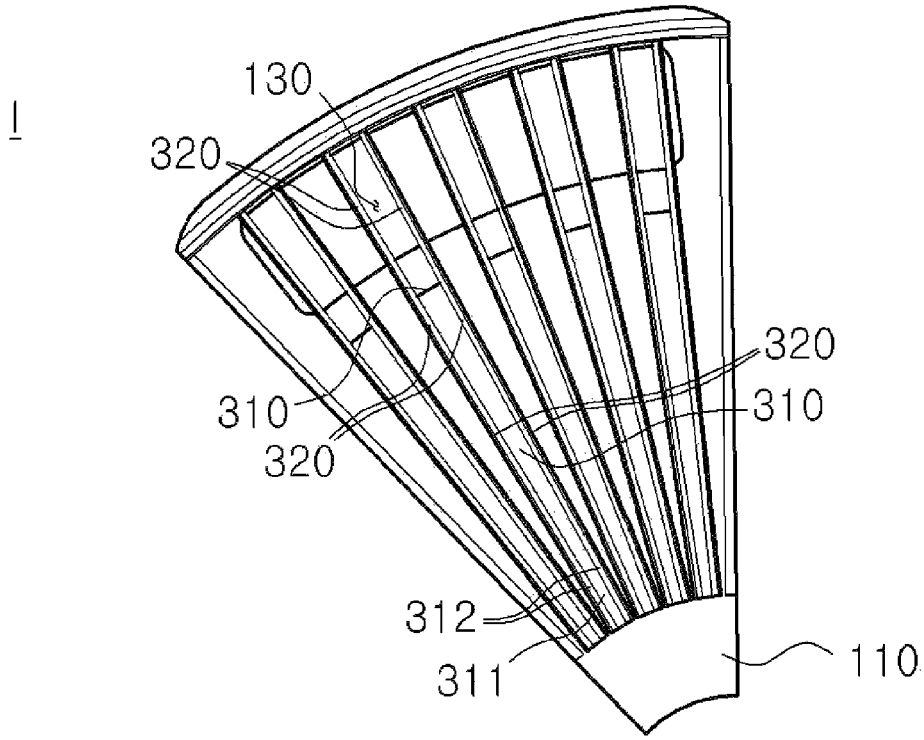
FIG. 12 is a partial conceptual diagram viewed from a viewpoint I of FIG. 9.
Figure 13:
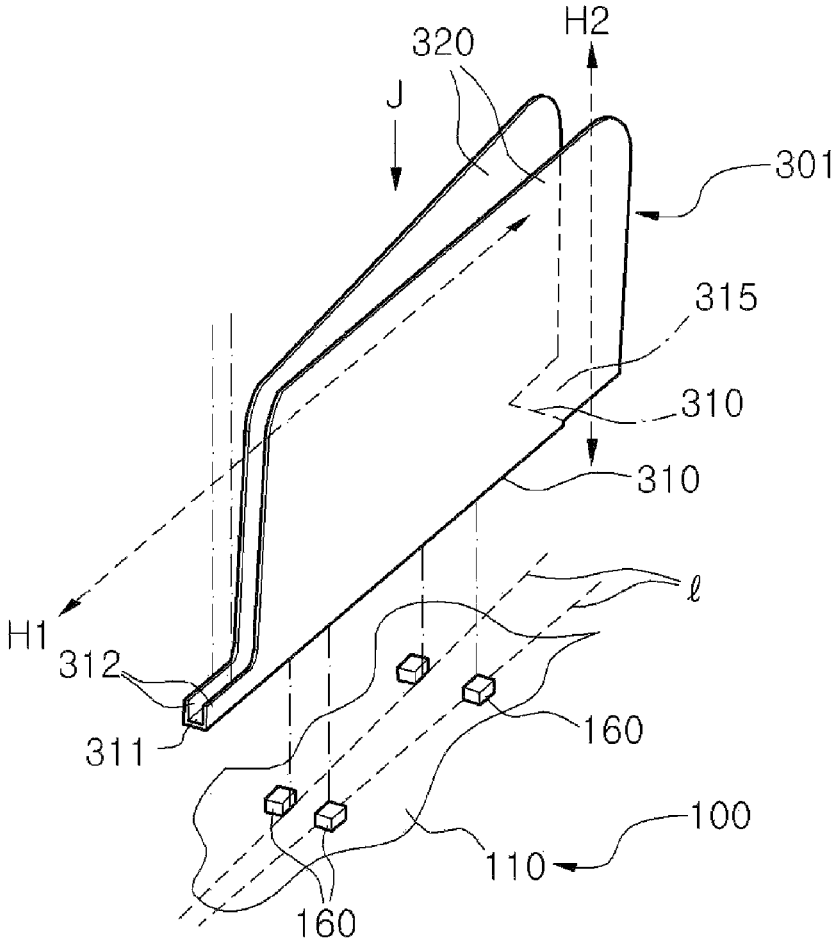
FIGS. 13 to 14 are diagrams illustrating an overall configuration of a unit heat sink element constituting a heat sink unit that is an essential part of the optical semiconductor lighting apparatus according to another embodiment of the present invention.
Figure 14:
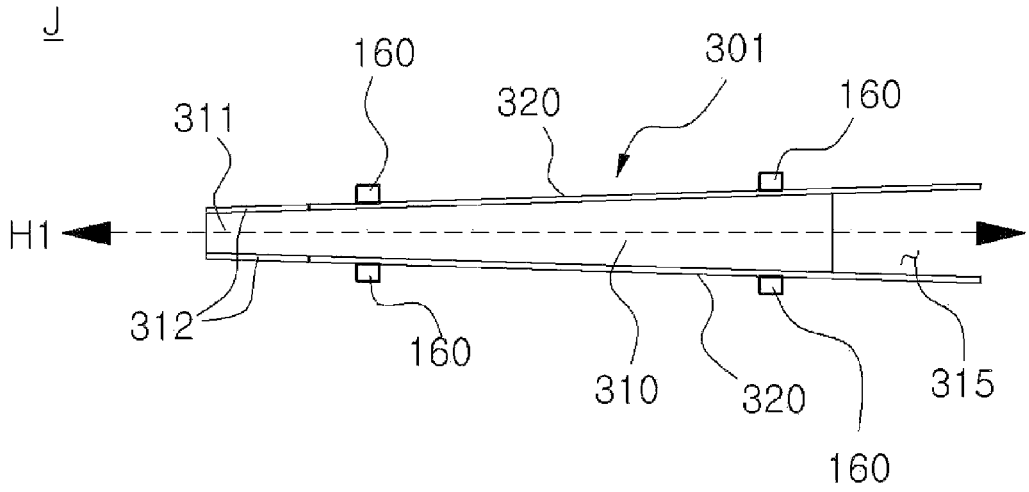
Figure 15:
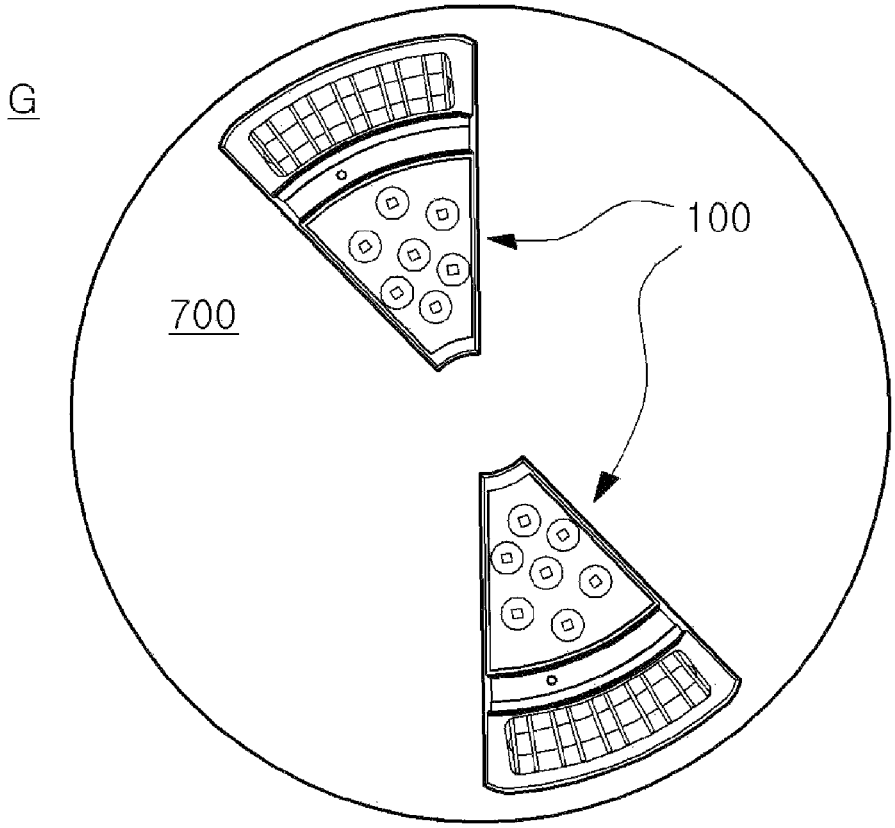
FIGS. 15 to 18 are conceptual diagrams illustrating actual application examples of optical semiconductor lighting apparatuses according to various embodiments of the present invention.
Figure 16:
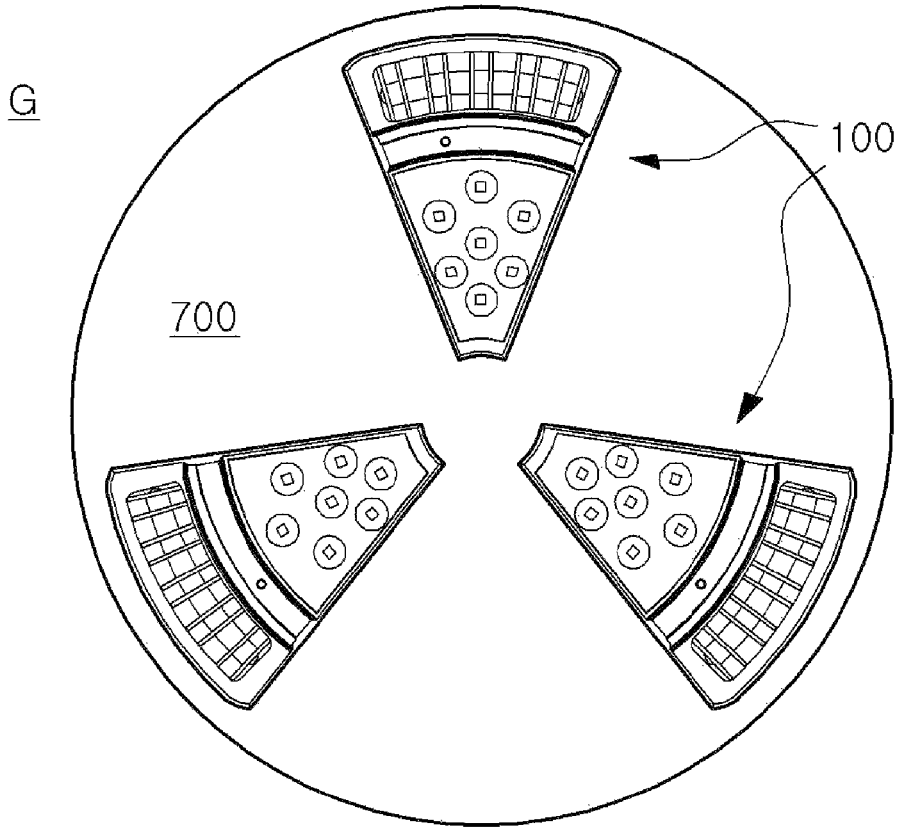
Figure 17:
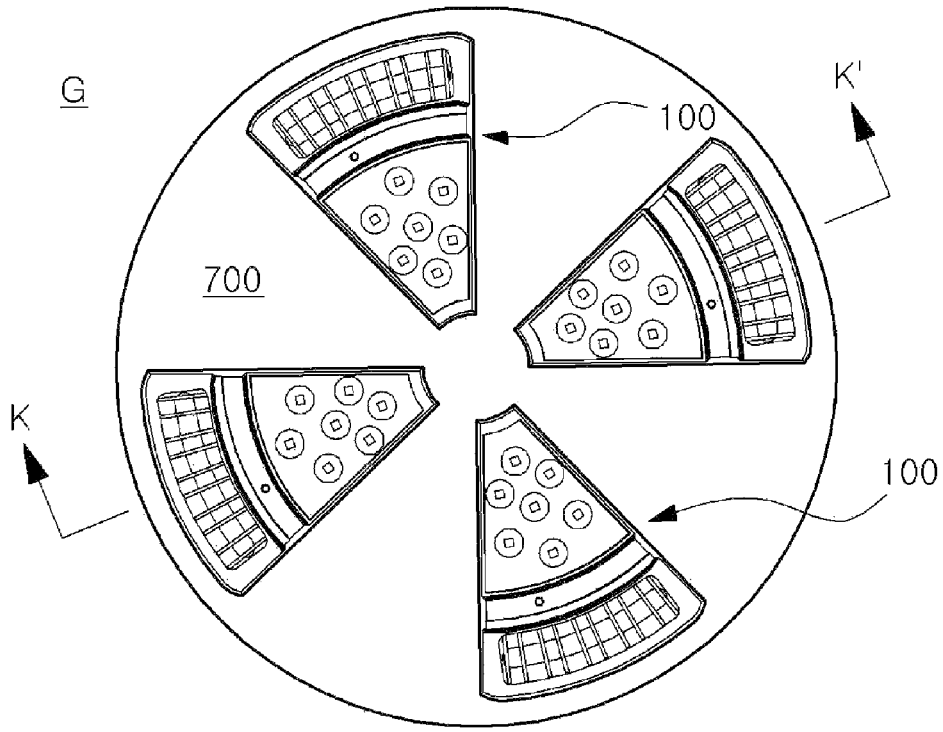
Figure 18:
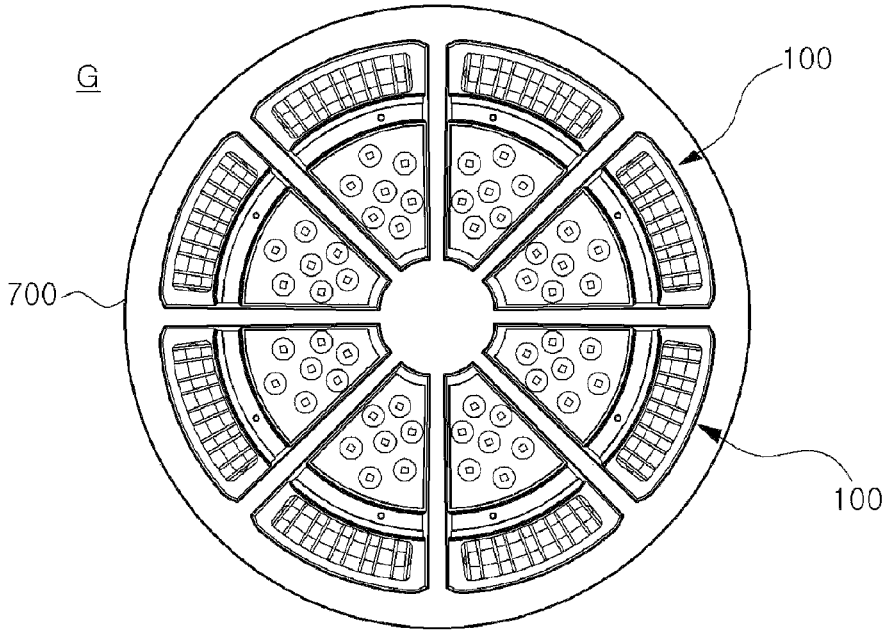

FIG. 10 is a cross-sectional view taken along line F-F' of FIG. 9. FIG. 11 is a partial conceptual diagram viewed from a viewpoint G of FIG. 9. FIG. 12 is a partial conceptual diagram viewed from a viewpoint I of FIG. 9. FIGS. 13 to 14 are diagrams illustrating an overall configuration of a unit heat sink element constituting a heat sink unit that is an essential part of the optical semiconductor lighting apparatus according to another embodiment of the present invention.

Figure 19:
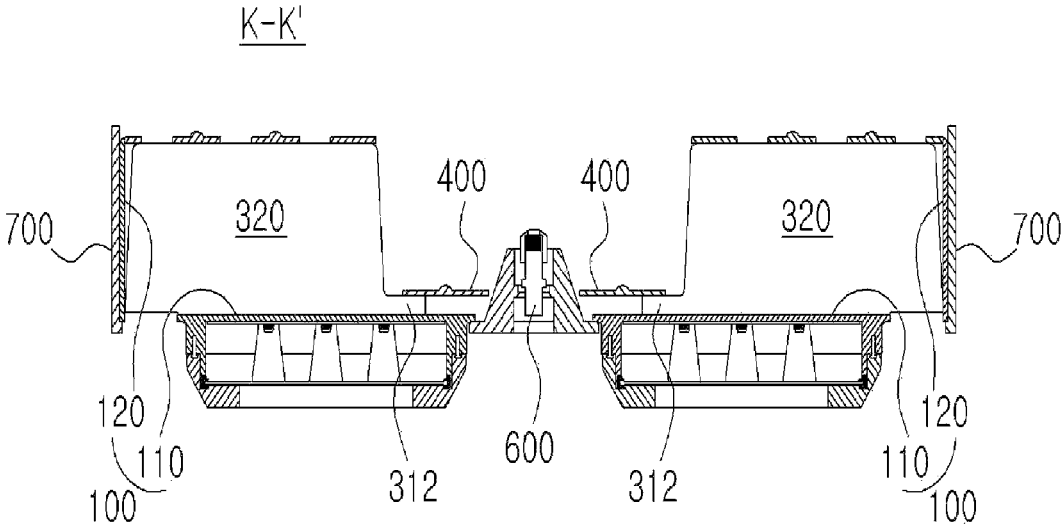
FIG. 19 is a cross-sectional view taken along line K-K' of FIG. 17.

FIGS. 15 to 18 are conceptual diagrams illustrating actual application examples of optical semiconductor lighting apparatuses according to various embodiments of the present invention. FIG. 19 is a cross-sectional view taken along line K-K' of FIG. 17.

In FIG. 8, reference numeral 600 denotes a waterproof connector.

In FIG. 9, the other side of the bottom surface 110 of the housing 100 refers to a side that gradually widens compared with one side thereof. One side of the bottom surface 110 of the housing 100 refers to a right lower end, and the other side thereof refers to a left upper end.

In FIG. 10, one side of the bottom surface 110 of the housing 100 refers to a right side, and the other side thereof refers to a left side.

In FIG. 11, one side of the bottom surface 110 of the housing 100 refers to a left upper side, and the other side thereof refers to a right lower side.

In FIG. 12, one side of the bottom surface 110 of the housing 100 refers to a right lower side, and the other side thereof refers to a left upper side.

In FIG. 13, one side of the bottom surface 110 of the housing 100 refers to a left lower side, and the other side thereof refers to a right upper side.

In FIG. 14, one side of the bottom surface 110 of the housing 100 refers to a left side, and the other side thereof refers to a right side.

In FIG. 19, reference numeral 600 denotes a waterproof connector. In FIGS. 7, 8, 9, 10 and 19, the outer side of the bottom surface 110 refers to a side facing a lower side of the drawing from the bottom surface 110, and the inner side of the bottom surface 110 refers to a side facing an upper side of the drawing from the bottom surface 110. The outer side and the inner side of the bottom surface 110 are equally applied throughout the drawings.

As illustrated, an engine body 800 is connected to an outer side of a bottom surface of the base casing 700, and a heat sink unit 300 is connected to an inner side of the bottom surface of the base casing 700.

The base casing 700 is a cylindrical member to provide a space for accommodating the heat sink unit 300, which will be described later, and also provide an area for mounting the engine body 800, which will be described later.

The engine body 800 is connected to the outer side of the bottom surface of the base casing 700 and is formed to have a top surface gradually widened from one side to the other side.

Although not specifically illustrated, it should be understood that the engine body 800 refers to a structure that includes a light emitting module (not illustrated) with semiconductor optical devices, and an optical member corresponding to the light emitting module. The engine body 800 is a structural concept extended up to a combination of a light emitting module and a power unit electrically connected thereto, which is defined in "Zhaga Consortium", the consortium for standardization of LED light engines.

The heat sink unit 300 includes a plurality of unit heat sink elements 301 (see FIGS. 13 and 14) each including a pair of heat sink sheets 320 disposed at the inner side of the bottom surface of the base casing 700 in a fan shape and facing each other.

In this case, the number of the unit heat sink elements 301 may be appropriately is increased or decreased according to the size of the housing 800, which is mounted on the outer side of the bottom surface of the base casing 700, or the light output amount of the light emitting module, which is mounted inside the engine body 800.

The heat sink unit 300 includes a bottom sheet 310 (see FIG. 9) contacting the base casing 700 so as to secure a sufficient heat transfer area, and a heat sink sheet 320 extends from both edges of the bottom sheet 310.

In addition, a plurality of engine body 800 are disposed radially from the central portion of the outer side of the bottom surface of the base casing 700. More specifically, in order to obtain excellent heat dissipation performance, the heat sink unit 300 may be disposed corresponding to a position where the engine body 800 is connected.

It is apparent that the following various embodiments as well as the above-described embodiment can also be applied to the present invention.

As described above, the base casing 700 provides a mounting space and area for the engine body 800 and the heat sink unit 300. As illustrated in FIG. 8, the base casing further includes a ring-shaped core fixing portion 400 for fixing the inner edges of the unit heat sink elements 301 at an upper side.

In addition, in order to protect the heat sink unit 300 and the components mounted inside the base casing 700 from external physical and/or chemical impacts, the base casing 700 may further include a ring-shaped cover 500 which is disposed at the upper side of the unit heat sink elements 301 and fixed to the edge of the base casing 700. Also, a plurality of upper vent slots 510 penetrate the cover 500.

In addition, the cover 500 is disposed at an upper side of the heat sink sheet 320 and connected to an upper edge of the base casing 700, such that heat generated from the light emitting module 200 is effectively discharged while inducing natural convection through the space where the heat sink unit 300 is formed.

Therefore, it is possible to cope with various installation and construction environments widely and actively by appropriately increasing or decreasing the number of the engine bodies 800 and the number of the unit heat sink elements 301 constituting the heat sink unit 300, regardless of the arrangement area in the inner and outer sides of the bottom surface of the base casing 700.

Meanwhile, in addition to the above-described structure, various structures illustrated in FIGS. 9 to 19 can also be applied to the present invention.

First, the heat sink unit 300 is included in the housing 100 where the light emitting module 200 is mounted.

The housing 100 forms the bottom surface 110 that is gradually widened from one side to the other side. To be specific, the housing 100 is formed in a fan shape to provide the space and area for mounting the light emitting module 200, the optical member, and the heat sink unit 300, which will be described later.

The light emitting module 200 includes at least one or more semiconductor optical devices 201 and is disposed at the outer side of the bottom surface 110 of the housing 100. The light emitting module 200 serves as a light source.

The optical member is connected to the outer side of the bottom surface 110 of the housing 100 and faces the light emitting module 2000. The optical member can adjust the light distribution area of light irradiated from the light emitting module 200.

In order to discharge generate from the light emitting module 200 to the outside of the housing 100, the heat sink unit 300 includes the plurality of unit heat sink elements 301 each including a pair of heat sink sheets 320 that are radially disposed in a fan shape at the inner side of the bottom surface 110 of the housing 100 and face each other.

Therefore, due to the structural characteristics of the bottom surface 110 of the housing 100, the above-described structure and the optical semiconductor lighting apparatus according to the embodiment of the present invention can adjust the light output amount by mounting a plurality of base casings 700 (see FIGS. 15 to 19), which will be described later.

As described above, the housing 100 provides the space and area for mounting the respective components of the present invention. The housing 100 further includes a side wall 120 extending along both sides of the bottom surface 110 and the edge of the other side of the housing 100, and the heat sink unit 300 is accommodated in the inner space where the side wall 120 is formed.

As described above, the optical member faces the light emitting module 200, and includes an optical cover 210 made of a transparent or translucent material. The optical cover 210 faces the light emitting module 200 and projects light irradiated from the light emitting module 200.

The optical member includes a lens 220 provided at the optical cover 210. The lens 220 corresponds to the semiconductor optical devices 201, and reduces or expands the area and range on which light is irradiated from the respective semiconductor optical devices 201.

Meanwhile, as illustrated in FIG. 10, the housing 100 may further include a connection rib 150 and a frame rib 170 so as to mount the optical member.

The connection rib 150 protrudes along the edge of the outer side of the bottom surface 110, and the frame rib 170 is connected to the connection rib 150. The edge of the optical member is fixed between the connection rib 150 and the frame rib 170.

The housing 100 may further include a first protrusion 152, which is stepped along the edge of the outer side of the connection rib 150, and a second protrusion 172, which is stepped along the edge of the outer side of the frame rib 170 and corresponds to the first protrusion 152.

The first protrusion 152 and the second protrusion 172 are provided for securely and tightly connecting the connection rib 150 and the frame rib 170. The first protrusion 152 and the second protrusion 172 are provided for securely fixing the optical member, that is, the edge of the optical cover 210.

In this case, a sealing member 180 may be connected to the optical member, that is, the edge of the optical cover 210, so as to maintain waterproofing and airproofing.

In addition, the housing 100 may further include the cover 500 disposed at the upper side of the heat sink sheet 320 and connected to the upper edge of the housing 100, such that heat generated from the light emitting module 200 is effectively discharged while inducing natural convection through the space where the heat sink unit 300 is formed.

Furthermore, the cover 500 protects the heat sink unit 300 and the components mounted inside the base casing 700 from external physical and/or chemical impacts.

The cover 500 may further include at least one or more upper vent slots 510 penetrating along a direction from one side to the other side of the housing 100.

In this case, the housing 100 may further include at least one or more lower vent slots 130 (see FIGS. 10 to 12) penetrating the edge of the other side of the bottom surface 110 thereof.

Meanwhile, as described above, the heat sink unit 300 is provided to obtain heat dissipation performance. The heat sink unit 300 includes a bottom sheet 310 contacting the inner is side of the bottom surface 110 of the housing 100 so as to form the heat sink sheets 320 constituting the unit heat sink element 301.

The heat sink sheets 320 extend from both edges of the bottom sheet 310.

In this case, in the space formed between the heat sink sheets 320, the first heat sinking path H1 (see FIGS. 10, 13 and 14) are formed in a fan shape from one side to the other side of the bottom surface 110 of the housing 100.

In addition, the second heat sinking path H2 (see FIGS. 10 and 13) is formed from the lower vent slot 130 to the upper vent slot 510 disposed at the outermost of the cover 500.

Therefore, as illustrated, natural convection is actively induced by forming a plurality of paths through which heat generated from the light emitting module 200 is discharged by the first and second heat sinking paths H1 and H2, thereby further increasing the heat dissipation efficiency.

In addition, the heat sink unit 300 may further include an extension sheet 311 and a fixing sheet 312, which can be used when the heat sink unit 300 is fixedly arranged at the base casing 700 to be described later.

That is, the extension sheet 311 extends from the inner end portion of the bottom sheet 310 toward one side of the bottom surface 110 of the housing 100, and the fixing sheet 312 extends along both edges of the extension sheet 311 and faces the extension sheet 311.

In this case, the fixing sheet 312 is connected to the heat sink sheet 320. In order for assembly, it is preferable that the height of the fixing sheet 312 protruding from the bottom surface 110 is lower than that of the heat sink sheet 320.

Due to the structural characteristic of the bottom sheet 310 disposed radially on the bottom surface 110, it is preferable that the bottom sheet 310 is formed in a tapered shape is such that the bottom sheet 310 is gradually widened from one side to the other side of the bottom surface 110, so as to secure a sufficient contact area.

In addition, as illustrated in FIG. 13, the housing 100 may further include a plurality of fixing protrusions 160 protruding on the opposite side and disposed along both edges of the bottom sheet 310, so as to provide a mounting space of the bottom sheet 310 constituting the unit heat sink element 301 and tightly fixing and supporting the lower side of the heat sink sheet 320.

Therefore, in the heat sink unit 300, the bottom sheet 310 and the heat sink sheet 320 constituting the unit heat sink element 301 are formed to have a U-shaped cross-section as a whole, and the bottom sheet 310 is disposed to contact the inner side of the bottom surface 110 of the housing 100. As a result, compared with the conventional heat sink fin structure, the heat transfer area is increased to further improve the heat dissipation effect.

In the conventional lighting apparatus, since the heat sink is manufactured by die casting, the volume and size thereof are increased. However, according to the embodiment of the present invention, the total weight of the product can be reduced by radially arranging the unit heat sink elements 301 including the bottom sheet 310 and the heat sink sheet 320 formed in a thin plate form.

Meanwhile, as illustrated in FIGS. 15 to 19, the optical power can be adjusted by arranging a plurality of housings 100 as the concept of the light engine, and the weight of the product can be reduced by increasing the arrangement efficiency of the semiconductor optical devices 201 per unit area. Moreover, the housing 100 can be arranged in the base casing 700 so as to provide high power products.

The heat sink sheets 320 of the heat sink unit 300 disposed in the adjacent housings 100 are disposed radially with respect to the central portion of the base casing 700.

To be specific, as illustrated in FIGS. 15 to 18, the plurality of housings 100 may be arranged radially with respect to the central portion of the base casing 700.

In this case, the arrangement efficiency of the housings 100 per unit area can be maximized when the other sides of the housings 100 are arranged to face the outer side of the base casing 700.

Although it is illustrated in the drawings that the base casing 700 has the bottom surface with a circular disk shape to form a cylindrical shape, the present invention is not necessarily limited thereto. Various applications and design modifications can also be made. For example, the base casing 700 may have a polygonal pillar shape with a polygonal bottom surface.

In addition, as illustrated in FIG. 19, the base casing 700 may include a core fixing portion 400 for pressing and fixing the upper edge of the fixing sheet 312. By arranging the core fixing portion 400 at the central portion of the base casing 700, the tightly connected state of the respective housings 100 can be maintained.

Therefore, as illustrated in FIGS. 15 to 18, when the housings 100 are arranged radially with respect to the central portion of the base casing 700, the first heat sinking path H1 is also formed radially. Therefore, heat generated from the light emitting module 200 can be effectively discharged through natural convention, together with the second heat sinking path H2.

In addition, although not specifically illustrated, a ventilation fan may be further mounted on the base casing 700 to forcibly convect heat generated from the light emitting module 200 and discharge the heat to the outside of the housing 100, thereby achieving a rapid is heat dissipation effect.

As described above, the basic technical spirit of the present invention is to provide an optical semiconductor lighting apparatus that can reduce the total weight of the product, can further improve the heat dissipation efficiency by inducing natural convection, is simple in the product assembly and installation and is easy in maintenance, and can provide products with high reliability by increasing the arrangement efficiency of semiconductor optical devices per unit area.

According to the present invention, the following effects can be obtained.

First, the heat sink unit is disposed radially in the housing where the light emitting module is mounted. The first heat sinking path is formed along the direction in which the heat sink is formed, and the second heat sinking path is formed in the vertical direction of the housing along the edge of the light emitting module. By actively inducing the natural convection through the first and second heat sinking paths, the heat dissipation efficiency can be significantly increased and the heat generation problem can be solved.

The heat sink sheets extend from both edges of the bottom sheet radially disposed in the housing including the semiconductor optical device, and have a U-shape facing each other. Therefore, the total weight of the product can be reduced, and the manufacturing cost of the product and the amount of raw materials used can be significantly reduced.

That is, by making the unit heat sink element in a sheet form, it is possible to solve the problem of the conventional heat sink manufactured by die casing that it is difficult to make the heat sink in the sheet form. Therefore, the weight of the product can be reduced, and the bottom sheet can solve the difficulty in securing the heat transferring area due to the line contact of the conventional sheet-type heat sink.

The unit heat sink element including the bottom sheet and the heat sink sheet is fit into the housing, and the cover where the upper vent slot is formed is connected to the housing. Since it is easy to assemble the product, failure sites can be checked immediately, and the maintenance and management are simple. Therefore, products with high reliability can be provided to consumers.

By providing the apparatus as the concept of the light engine including the engine body, the arrangement efficiency of the semiconductor optical devices per unit area can be increased, and products with high reliability can be provided.

That is, by arranging the engine bodies as the concept of the light engine radially in the base casing defining a separate accommodation space, high power lighting can be implemented. Furthermore, the output power can be appropriately varied according to the installation and construction environment.

While the embodiments of the present invention have been described with reference to the specific embodiments, it will be apparent to those skilled in the art that various changes and modifications may be made without departing from the spirit and scope of the invention as defined in the following claims.

What is claimed is:

1. An optical semiconductor lighting apparatus comprising:

a housing;

a light emitting module including at least one or more semiconductor optical devices and disposed at an outer side of a bottom surface of the housing;

a heat sink unit disposed radially at an inner side of the bottom surface of the housing and forming a communication space at a central portion of the inner side of the bottom surface of the housing;

a first heat sinking path formed radially from the central portion of the inner side of the bottom surface of the housing; and a second heat sinking path formed along an edge of the bottom surface of the housing in a vertical direction, wherein the heat sink unit comprises a pair of heat sink sheets facing each other, a plurality of unit heat sink elements forming the first heat sinking path are disposed between the adjacent heat sink sheets, the housing further comprises a plurality of lower vent slots penetrating the bottom surface of the housing along an edge of the light emitting module, and the lower vent slots communicate with the second heat sinking path.

2. The optical semiconductor lighting apparatus of claim 1, wherein the heat sink sheets are substantially perpendicular to the bottom surface of the housing.

3. The optical semiconductor lighting apparatus of claim 1, wherein at least a part of the unit heat sink element contacts the bottom surface of the housing at a side.

4. The optical semiconductor lighting apparatus of claim 3, wherein the unit heat sink element comprises a bottom sheet, and the heat sink sheets extend along both edges of the bottom sheet and face each other.

5. The optical semiconductor lighting apparatus of claim 1, further comprising a core fixing portion that is disposed at the central portion of the inner side of the bottom surface of the housing and fixes an inner end portion of the heat sink unit.

6. The optical semiconductor lighting apparatus of claim 1, wherein an outer end portion of the heat sink unit communicates with the second heat sinking path formed from the outer side of the bottom surface of the housing.

7. The optical semiconductor lighting apparatus of claim 1, wherein:

the housing further comprises a side wall extending along the edge of the bottom surface of the housing;

the heat sink unit is accommodated inside the side wall; and the second heat sinking path is formed in parallel to the side wall.

8. The optical semiconductor lighting apparatus of claim 7, wherein the housing further comprises a cover that is disposed at connected to an upper edge of the side wall and has a communication hole at a central portion thereof.

9. The optical semiconductor lighting apparatus of claim 7, wherein the housing further comprises:

a cover mutually communicating with the first and second heat sinking paths and having a communication hole at a central portion thereof; and a plurality of upper vent slot penetrating circumferences of a plurality of virtual concentric circles formed along a direction in which the cover is formed.

10. The optical semiconductor lighting apparatus of claim 1, wherein the housing further comprises cover that is disposed at an upper side of the heat sink unit, is connected to the housing, and has a communication hole connected to the communication space.

11. The optical semiconductor lighting apparatus of claim 10, wherein the cover further comprises a plurality of upper vent slots penetrating circumferences of a plurality of virtual concentric circles formed along a direction in which the cover is formed.

12. The optical semiconductor lighting apparatus of claim 4, further comprising:

an extension sheet extending from an inner end portion of the bottom sheet toward a central portion of the inner side of the bottom surface of the housing; and a fixing sheet extending along both edges of the extension sheet and facing each other, wherein the fixing sheet is connected to the heat sink sheet.

13. The optical semiconductor lighting apparatus of claim 12, further comprising a core fixing portion that is disposed at the central portion of the inner side of the bottom surface of the housing and fixes an upper edge of the fixing sheet.

14. The optical semiconductor lighting apparatus of claim 4, wherein the bottom sheet is formed in a tapered shape, such that the bottom sheet is gradually widened toward the edge of the inner side of the bottom surface of the housing.

15. The optical semiconductor lighting apparatus of claim 4, wherein the housing further comprises a plurality of fixing protrusions that protrude from the inner side of the bottom surface of the housing and are disposed along both edges of the bottom sheet.

16. The optical semiconductor lighting apparatus of claim 4, wherein the communication space is formed between the plurality of bottom sheets and the inner end portion of the heat sink sheet from the central portion of the bottom surface of the housing, and communicates with the first heat sinking path.

17. The optical semiconductor lighting apparatus of claim 1, wherein the housing further comprises a ventilation fan disposed in the communication space.

* * * * *